US008006823B2

(12) United States Patent
Holzner et al.

(10) Patent No.: US 8,006,823 B2
(45) Date of Patent: Aug. 30, 2011

(54) HANDRAIL

(75) Inventors: Armin Holzner, Ternitz (AT); Herwig Miessbacher, Grosslobming (AT); Reinhard Zoernpfenning, Neunkirchen (AT)

(73) Assignee: Semperit Aktiengesellschaft Holding, Vienna (AT)

( * ) Notice: Subject to any disclaimer, the term of this patent is extended or adjusted under 35 U.S.C. 154(b) by 294 days.

(21) Appl. No.: 12/093,210

(22) PCT Filed: Nov. 9, 2006

(86) PCT No.: PCT/AT2006/000463

§ 371 (c)(1),
(2), (4) Date: Feb. 2, 2009

(87) PCT Pub. No.: WO2007/053873

PCT Pub. Date: May 18, 2007

(65) Prior Publication Data

US 2009/0218192 A1 Sep. 3, 2009

(30) Foreign Application Priority Data

Nov. 9, 2005 (AT) ..... A 1829/2005

(51) Int. Cl.
*B66B 23/22* (2006.01)

(52) U.S. Cl. ..... 198/337

(58) Field of Classification Search ..... 198/337
See application file for complete search history.

(56) References Cited

U.S. PATENT DOCUMENTS

| | | | | |
|---|---|---|---|---|
| 5,255,772 | A | 10/1993 | Ball et al. | |
| 6,237,740 | B1 | 5/2001 | Weatherall et al. | |
| 6,673,431 | B1 | 1/2004 | Ledzinski | |
| 6,761,259 | B1 * | 7/2004 | Onodera et al. | 198/337 |
| 2005/0173224 | A1 * | 8/2005 | Caunce | 198/337 |
| 2009/0071798 | A1 * | 3/2009 | Durrer et al. | 198/337 |

FOREIGN PATENT DOCUMENTS

| | | |
|---|---|---|
| CA | 2247737 | 3/1999 |
| DE | 196 41 502 | 4/1998 |
| DE | 197 01 063 | 7/1998 |
| DE | 198 32 158 | 2/1999 |
| DE | 197 42 258 | 4/1999 |
| DE | 299 03 376 | 7/1999 |
| DE | 102 08 958 | 8/2003 |
| EP | 1362893 | 11/2003 |
| GB | 947160 | 1/1964 |
| GB | 2327405 | 1/1999 |
| JP | 61 000252 | 1/1986 |
| JP | 2003 327380 | 11/2003 |
| JP | 2005 179018 | 7/2005 |
| WO | 00/01607 | 1/2000 |
| WO | 00/15536 | 3/2000 |

* cited by examiner

*Primary Examiner* — James R Bidwell
(74) *Attorney, Agent, or Firm* — Greenblum & Berstein, P.L.C.

(57) ABSTRACT

The invention encompasses a handrail for escalators or moving walkways that includes a grip piece of a thermoplastic elastomer including soft segments and hard segments and optionally a sliding layer arranged on the underside of the grip piece relative to the mounting orientation of the handrail. A ratio of the proportions of the soft segments to the hard segments is selected from a range with a lower limit of 1:1 and an upper limit of 9:1, or, in a variation, from a range with a lower limit of 1.5:1 and an upper limit of 6:1, or, in another variation, from a range with a lower limit of 2.5:1 and an upper limit of 4:1.

45 Claims, 2 Drawing Sheets

HANDRAIL

BACKGROUND OF THE INVENTION

1. Field of the Invention

The invention relates to a handrail for escalators or moving walkways with a grip piece of a thermoplastic elastomer with soft and hard segments, a handrail for escalators or moving walkways with a grip piece of a polymer material and a sliding layer made of a woven fabric with warp threads and weft threads and arranged thereon or connected thereto, extending at least in part over a lower surface—relative to the mounting orientation, and a method for producing handrails of this type.

2. Description of Background and Other Information

Handrails for escalators, moving walkways, or similar applications are used as safety elements for passenger transport. For this purpose, the handrail must render possible a safe grip for the passenger and must withstand the dynamic loads or the environmental influences during operation without being damaged thereby. Handrails known from the prior art have a C-shaped cross section and are usually constructed from a plurality of different materials in order to meet these requirements. The handrail surface that can be touched by the passenger usually comprises an elastomer mixture. Furthermore, the handrail cover protects all of the components lying underneath from diverse environmental influences and must therefore be resistant thereto. To increase the dimensional stability of the handrail cross section, reinforcement inserts, e.g., fabric cords, are used. A sufficiently high lip rigidity, i.e., rigidity of the side areas of the handrail can also be achieved thereby.

The handrail is expected to retain its cross-sectional shape during its entire service life, i.e., the cross section must not be excessively enlarged or excessively reduced during its service life. In addition to a development of great noise, upon contact with the handrail track, the reduction would also lead to heat generation, to drive problems and ultimately to the destruction of the handrail. In turn, the result of an enlargement would be that, on the one hand, the passenger could become jammed between the handrail lip and the guide track and, on the other hand, the handrail could jump out of the guide track.

Furthermore, to absorb longitudinal forces the handrail contains in its cross section so-called tensile carriers that must have a defined minimum breaking strength including in the impact area.

Finally, the so-called sliding layer forms the contact surface of the handrail to the handrail guide or to the handrail drive system.

Currently, essentially three materials are used in the handrail sector for moving walkways or escalators. On the one hand, this is a natural rubber or synthetic styrene butadiene rubber (SBR). Furthermore, there are handrails of Hypalon®, a chlorosulfonated polyethylene, and handrails of polyurethane on the market.

In addition, handrails have also already been described, which comprise at least in part a thermoplastic elastomer.

DE 197 42 258 A1 thus discloses a handrail for escalators and moving walkways with a grip piece of a polymer material, a reinforcing layer absorbing tensile forces, a layer for shape stabilization of textile layers arranged in the transverse direction and a finishing sliding layer. The layers are combined to form a textile structure in one piece and can be connected to the grip piece in a manufacturing operation. The grip piece itself can be made of a thermoplastic elastomer.

DE 198 32 158 A1 describes a handrail for an escalator or a moving walkway with a thermoplastic elastomer that preferably has at least a Shore hardness of 80 and preferably has a C-shaped profile. The inwardly facing surface of the handrail can comprise a section of a different material that preferably has a lower hardness than the rest of the handrail and that moreover is extruded. Ribs or grooves may be provided on the inwardly facing or drive surface of the handrail in order to vary the surface area of contact with the drive means. The use of the hard thermoplastic material to form the nose and the outer section of the handrail increases shape retention during extensive use and lowers the requirement for further reinforcement. The friction between the guide means on which the handrail travels is also reduced.

DE 299 03 376 U1 discloses a handrail for escalators and moving walkways that is produced (extruded) from a thermoplastic elastomer (TPE, TPO, TPU), preferably a thermoplastic polyurethane elastomer. A tensile carrier that is located in the center of the handrail is embodied as a roller chain with lateral bolts and can be clipped from below in a positive manner into a recess provided for this purpose. Hollow channels can be provided in the extruded profile, which channels help to save material as well as reducing the bending stiffness. Channels located to the right and to the left next to the tensile carrier recess can be provided on the underside of the handrail, in which channels the balustrade guide of the escalator runs. A thin-walled hose of ultra high molecular weight polyethylene (alternatively polytetrafluoroethylene) can be arranged therein, which hose is compressed when fixed onto the balustrade guide. The friction coefficient between guide and handrail and the abrasive wear are thereby reduced to a minimum.

Finally, handrails are also described, which comprise at least in part a thermoplastic material. For example, a handrail with a C-shaped profile is known from WO 00/01607 A, which handrail comprises a first layer of a thermoplastic material, a second layer of a likewise thermoplastic material, which second layer is arranged on the first layer and defines the outer surface of the hand rail, as well as a sliding layer that is arranged on the lower first thermoplastic layer. A tensile carrier is incorporated into the first layer and this first layer is of a harder thermoplastic material than the second layer.

SUMMARY OF THE INVENTION

The present invention is directed to a handrail with improved properties.

More particularly, the invention includes a handrail in which the grip piece comprises a thermoplastic elastomer in which the ratio of the proportions of soft segments to hard segments is selected, in a particular embodiment, from a range with a lower limit of 1:1 and an upper limit of 9:1. In another particular embodiment, the ratio of soft to hard segments is selected from a range with a lower limit of 1.5:1 and an upper limit of 6:1. In another particular embodiment, the ratio of soft to hard segments is selected from a range with a lower limit of 2.5:1 and an upper limit of 4:1. Further, the sliding layer of the handrail comprises weft threads and warp threads, the weft threads having a higher rigidity (modulus of elasticity) than the warp threads. Still further, the invention includes a method for producing a handrail of this type.

It is advantageous thereby that a handrail embodied in this manner, on the one hand, has a good tactile property and, on the other hand, the corresponding strength, so that it can be used if necessary without additional reinforcing elements. Handrails according to the invention show a good abrasion resistance, which is advantageous with respect to the constant contact with drive elements. Furthermore, handrails according to the invention have a high service life despite the frequent negative and positive bending of the handrail. Moreover, only a very low, reversible, temperature-dependent change of length is present, so that handrails of this type also exhibit a good dimensional stability. Furthermore, through the greater rigidity of the weft threads of the fabric of the sliding layer a corresponding rigidity and thus in turn a dimensional stability of the handrail is achieved, the handrail in the longitudinal direction also having a corresponding flexibility, which is important for the bending behavior of the handrail.

To further improve these properties, it is advantageous if according to an embodiment the proportion of the hard segments is selected from a range with a lower limit of 10%, 15% in a variation, or 20%, in another variation, and an upper limit of 50%, or 40% in a variation, or 30% in another variation, and/or the proportion of the soft segments is selected from a range with an upper limit of 90%, or 85% in a variation, or 80% in another variation, and a lower limit of 70%, or 60% in a variation, or 50% in another variation, based on the total composition of the thermoplastic elastomer.

For the improvement of the ratio of rigidity to flexibility, it is possible according to a variant of the invention for the degree of crystallinity of the thermoplastic elastomer to be selected from a range with a lower limit of 10%, or 20% in a variation, or 25% in another variation, and an upper limit of 50%, or 40% in a variation, or 30% in another variation.

The thermoplastic elastomer can be a thermoplastic polyurethane block copolymer, at least comprising monomer units A and B, e.g., a diblock copolymer ($[AB]_n$), a triblock copolymer ($A_n$-$B_m$-$A_n$) a segment copolymer ($[A_a$-$B_b]_n$) a star block copolymer ($[A_n$-$B_m]_xX$ where x>2). It is advantageous thereby that a corresponding flexibility of the handrail is retained over a broad temperature range so that it can be assembled in the same manner all over the world, regardless of the place of use. Furthermore, a handrail of this type also exhibits a high wear resistance. The buckling resistance and breaking strength are likewise high and the dynamic loadability is also improved. A handrail of this type exhibits a good weather resistance as well as a resistance to oil, grease and solvents.

For the further improvement of these properties it is advantageous if the proportion of the monomer units B of the molecules of the soft segments in the polymer chain of the thermoplastic polyurethane is selected from a range with a lower limit of 20%, or 30% in a variation, or 35% in another variation, and an upper limit of 70%, or 60% in a variation, or 50% in another variation, based on the total mixture of soft and hard segments.

The soft segments can thereby be formed at least of one long-chain compound with at least two hydroxy groups, in particular a long-chain diol, such as a polyester diol and/or a polyether diol, with a relative molecular mass of 600 to 4000, the long-chain diol being selected in particular from a group comprising 1,4-bis(2-hydroxyethoxy)benzene[hydroquinone bis-(2-hydroxyethyl)ether], polytetrahydrofurane, poly(oxytetramethylene)glycol, poly(1,2-oxypropylene)glycol, poly(tetramethylene adipic acid)glycol, poly(ethylene adipic acid)glycol, poly(ϵ-caprolactam)glycol, poly(hexamethylene carbonate)glycol, polycaprolactone. Mixtures thereof, such as, e.g., 1,4-bis(2-hydroxyethoxy)benzene[hydroquinone bis-(2-hydroxyethyl)ether] and/or poly tetrahydrofurane and/or poly(oxytetramethylene)glycol and/or poly (1,2-oxypropylene)glycol and/or poly(tetramethylene adipic acid)glycol and/or poly(ethylene adipic acid)glycol and/or poly(ϵ-caprolactam)glycol and/or poly(hexamethylene carbonate)glycol and/or polycaprolactone with 1,4-bis(2-hydroxyethoxy)benzene[hydroquinone bis-(2-hydroxyethyl) ether] and/or poly tetrahydrofurane and/or poly (oxytetramethylene)glycol and/or poly(1,2-oxypropylene) glycol and/or poly(tetramethylene adipic acid)glycol and/or poly(ethylene adipic acid)glycol and/or poly (ϵ-caprolactam) glycol and/or poly(hexamethylene carbonate)glycol and/or polycarprolactone are likewise possible. The advantage is attained in particular with the polyether diols that a handrail made thereof shows an improved hydrolytic resistance and microbial resistance so that, if necessary, further additives for improving these properties can be omitted. It is furthermore advantageous thereby that the flexibility of the handrail can be varied through the use of the given compounds, so that different handrail lengths can be taken into account. It is advantageous thereby that the rigidity of the handrail does not fall below a predetermined measurement.

In order to obtain a desired ratio between flexibility and rigidity of the handrail, it is provided according to a further embodiment of the invention that the hard segments are formed by at least one short-chain compound with at least two hydroxyl groups, in particular a short-chain diol, with a relative molecular mass of 61 to 600, the short-chain diol being selected in particular from a group comprising 1,4-butanediol,1,6-hexanediol, ethylene glycol, diethylene glycol, triethylene glycol, propylene glycol, dipropylene glycol, 2,2-dimethyl-1,3-propanediol, 1,10-decanediol, 1,4-cyclohexanedimethanol. Mixtures thereof, such as, e.g., 1,4-butanediol and/or 1,6-hexanediol and/or ethylene glycol and/or diethylene glycol and/or triethylene glycol and/or propylene glycol and/or dipropylene glycol and/or 2,2-dimethyl-1,3-propanediol and/or 1,10 decanediol, 1,4-cyclohexanedimethanol with 1,4-butanediol and/or 1,6-hexanediol and/or ethylene glycol and/or diethylene glycol and/or triethylene glycol and/or propylene glycol and/or dipropylene glycol and/or 2,2-dimethyl-1,3-propanediol and/or 1,10-decanediol and/or 1,4-cyclohexanedimethanol, are likewise possible.

The thermoplastic elastomer can be formed by reaction of the compound(s) comprising at least two hydroxy groups with at least one isocyanate from a group comprising aromatic isocyanates, in particular diisocyanates, such as, e.g., 4,4'-methylene diphenyl diisocyanate, 3,3'-dimethyl-4,4'-biphenyldiisocyant, 1,5-naphthalene-diisocyanate, toluoylene diisocyanate, aliphatic isocyanate, such as, e.g., 4,4'-dicyclohexylmethane diisocyanate, hexamethylene diisocyanate, hexamethylene diisocyanate-triisocyanurate, isophorone diisocyanate. The compound(s) comprising at least two hydroxy groups can be a polyol selected from a group comprising polyols based on polyadipates of short-chain diols with two functional hydroxy groups and 2 to 20 carbon atoms, e.g., polycaprolactones, polycarbonate diols and/or polyols with more than two free hydroxy groups, such as, e.g., pentaerythrite. The compound(s) comprising the at least two hydroxy groups can likewise be a polyol that has a relative molecular mass, selected from a range with a lower limit of 1000 and an upper limit of 2000. Mixtures of the cited compounds, such as, e.g., aromatic isocyanates, in particular diisocyanates, such as, e.g., 4,4'-methylene diphenyl-diisocyanate and/or 3,3'-dimethyl-4,4'-biphenyldiisocyant and/or 1,5-naphthalene-diisocyanate and/or toluoylene diisocyanate, aliphatic isocyanates, such as, e.g., 4,4'-dicyclohexylmethane diisocyanate and/or hexamethylene diisocyanate and/or hexamethylene diisocyanate-triisocyanurate and/or isophorone diisocyanate with at least one aromatic isocyanate, in particular diisocyanate, such as, e.g., 4,4'-methylene diphenyl-diisocyanate and/or 3,3'-dimethyl-4,4'-biphenyldiisocyanate and/or 1,5-naphthalene-diisocyanate and/or toluoylene diisocyanate and/or at least one aliphatic isocyanate, such as, e.g., 4,4'-dicyclohexylmethane diisocyanate and/or hexamethylene diisocyanate and/or hexamethylene diisocyanate-triisocyanurate and/or isophorone diisocyanate, or a polyol that has a relative molecular mass, selected from a range with a lower limit of 1000 and an upper limit of 2000, are also possible.

For the number of bonds, thus also for mechanical strength, it is advantageous if compound comprising at least two hydroxy groups has an acid number of less than 1 mg KOH/g compound.

In addition to embodying the grip piece as thermoplastic polyurethane it is also possible within the scope of the invention to form the handrail from a thermoplastic vulcanisate (TPE-V). It is thus possible to combine the properties of vulcanizable rubber with the easy processability of thermoplastic materials. A resistance to chemicals is achieved therewith that is comparable to chloroprene rubber mixtures, in particular for aqueous liquids, oil and hydrocarbons. An improved dynamic fatigue strengths are also achieved. The ozone resistance and weather resistance can also be improved.

The thermoplastic vulcanisate can be formed by an ethylene/propylene diene methylene (EPDM) polypropylene mixture, the EPDM proportion of the mixtures being selected according to an embodiment variant from a range with a lower limit of 20%, or 25% in a variation, or 30% in another variation, and an upper limit of 45%, or 40% in a variation, 35%, or is selected pursuant to a further embodiment of the polypropylene proportion of the mixture from a range with a lower limit of 5%, or 7% in a variation, or 10% in another variation, and an upper limit of 25%, or 17% in a variation, or 15% in another variation. Depending on the embodiment of the EPDM/PP blends, i.e., mechanical EPDM/PP blend or EPDM/PP blend with partly crosslinked EPDM phase or highly crosslinked EPDM phase, the elongation at break can be adjusted to values from approx. 300 or 350% or for mechanical EPDM/PP blends values in the order of magnitude of 600% to 800% can be achieved. The breaking strength can be likewise varied in a corresponding manner, for example, between 5 MPa and 30 MPa.

In order to vary the handrail properties further or to produce special properties it is possible to add to the EPDM/PP mixture at least one further additive, selected from a group comprising softening agents, fillers, colorants, antibacterial active ingredients, crosslinking agents or mixtures thereof.

As mentioned above, it is possible with the handrail according to the invention to embody the grip piece in one layer, through which the production as well as the subsequent splice formation to join the handrail ends can be simplified accordingly, thus reducing the production costs.

It is thereby possible that at least one tensile carrier, for example, of steel, is embedded in the grip piece in order to render possible a higher longitudinal stability, i.e., a low variance of the change in length during the operation of the handrail. A correspondingly simpler structure is also possible by embedding in the grip piece.

Within the scope of the invention it is of course also possible to embody the grip piece in multiple layers if required and to embody at least several of the layers of optionally different thermoplastic elastomers in order to obtain a mix of properties, which cannot be achieved through one material.

It is advantageous thereby if the tensile carrier is embedded in an outer layer of the grip piece, which can make it possible to improve the flexibility of the handrail during bending.

It is further possible to embody the grip piece in at least two layers with a cover layer and a reinforcing layer arranged beneath it relative to the mounting orientation of the handrail, short fibers being embedded in the reinforcing layer. The handrail can thus be given an improved rigidity, wherein the tensile carrier can optionally be omitted. Furthermore, the production of the handrail is simplified, since the short fibers can already be added to the mixture for the handrail, i.e., the reinforcing layer, and this mixture can therefore be processed with conventional methods.

The short fibers can be formed by a material selected from a group comprising inorganic materials, such as, e.g., carbon, glass, metals or alloys, such as, e.g., steel, aluminum, copper, and organic materials, such as, e.g., synthetic fibers, e.g., of nylon, polyester, aromatic polyamides (Kevlar), or natural fibers, for example of cotton, cellulose fibers, viscose, and mixtures thereof, such as, e.g., inorganic materials, such as, e.g., carbon, and/or glass, and/or metals or alloys, such as, e.g., steel and/or aluminum and/or copper and/or organic materials, such as, e.g., synthetic fibers, for example of nylon and/or polyester and/or aromatic polyamides (Kevlar) and/or natural fibers, for example, of cotton and/or cellulose fibers and/or viscose with inorganic materials, such as, e.g., carbon and/or glass and/or metals or alloys, such as, e.g., steel and/or aluminum and/or copper and/or organic materials, such as, e.g., synthetic fibers, for example of nylon and/or polyester and/or aromatic polyamides (Kevlar) and/or natural fibers, for example, of cotton and/or cellulose fibers and/or viscose.

The reinforcing layer can be embodied to be interrupted in the longitudinal direction, wherein, if a tensile carrier is used in the handrail, it is advantageous in this case if this tensile carrier is arranged in the cover layer. Improved bending properties can be achieved by the interruption of the reinforcing layer.

Furthermore, it is possible that the reinforcing layer has at least approximately the same hardness as the cover layer, so as not to thus negatively influence the hardness of the entire handrail.

In a further embodiment of the sliding layer it is provided that the warp threads have an initial modulus of elasticity according to ASTM D 885, selected from a range with a lower limit of 4.5 GPa, or 5.0 GPa in a variation, or 5.3 GPa in another variation, and an upper limit of 12 GPa, or 10 GPa in a variation, or 9 GPa in another variation, through which the handrail can be given an improved longitudinal elasticity.

The warp threads can be formed by staple fibers, wherein these staple fibers can be selected according to an embodiment variant from a group of materials comprising polyamides, polyimides, in particular aromatic para-aramids, polyester, polyolefins, e.g., polypropylene and mixtures thereof, such as, e.g., polyamides and/or polyimides and/or in particular aromatic para-aramids and/or polyester and/or polyolefins, e.g., polypropylene, with polyamides and/or polyimides, in particular aromatic para-aramids and/or polyesters and/or polyolefins, e.g., polypropylene. The breaking strength of the warp threads can thus be improved.

On the other hand, it is also possible to form the warp threads from rubber threads, wherein the material compatibility to the material of the cover layer or the other layers of the handrail can be improved.

The weft threads can have a rigidity (modulus of elasticity) according to ASTM D 885, selected from a range with a lower limit of 6.0 GPa, or 7.0 GPa in a variation, or 8.0 GPa in another variation, and an upper limit of 175 GPa, or 165 GPa in a variation, or 150 GPa in another variation, through which a high lip rigidity of the handrail is achieved and thus the lifting of the handrail from the balustrade or guide arrangement can be better prevented.

The weft threads can thereby be selected from a group of materials comprising polyamide, polyester, multifilament yarns, aramids or mixtures thereof, such as, e.g., polyamide and/or polyester and/or multifilament yarns and/or aramids with polyamide and/or polyester and/or multifilament yarns and/or aramids in order to improve these properties of the sliding layer for handrails.

The polymer material of the grip piece can be selected from a group of materials comprising thermoplastic elastomers, such as, e.g., TPU (thermoplastic polyurethane), TPV (thermoplastic vulcanisates), TPO (thermoplastic polyolefins) SBS or SIS or SBC (thermoplastic styrene triblock copolymers), TP-NR (thermoplastic natural rubber), TP-NBR (thermoplastic nitrile rubber), TP-FKM (thermoplastic fluorinated rubber), CPO or CPA (copolymer polyester), PEBA (polyether block amides), furthermore EPDM, natural rubber, CSM, CR (isoprene rubber), SBR (styrene-butadiene rubber), BR (butyl rubber), NBR (nitrile rubber), PU (polyurethane) and mixtures or blends thereof. The sliding layer can thus also be used for handrail materials already known.

It is advantageous thereby if the grip piece has a hardness according to Shore A, selected from a range with a lower limit of 55 ShA, or 63 ShA in a variation, or 70 ShA in another variation, and an upper limit of 50 ShD, or 45 ShD in a variation, or 40 ShD in another variation. In particular grip pieces of a thermoplastic elastomer can thereby have a hardness in the range of 40 ShD to 45 ShD and those of a cross-lined elastomer can have a hardness in the range between 60 ShA and 70 ShA.

It is thus also possible to form the grip piece in one layer with high strength of the handrail at the same time.

It is also advantageous if the sliding layer is embedded, at least in some areas, in particular the side areas thereof, into the grip piece in order to prevent the tear resistance of the delamination of the sliding layer as far as possible.

The handrail can be produced continuously through extrusion or, in the case of multiple layers, by means of coextrusion and or intermittently through stacking the individual layers and subsequently by press vulcanization, continuous methods being preferred within the scope of the invention.

BRIEF DESCRIPTION OF THE DRAWINGS

The invention is described in more detail below based on the exemplary embodiments, illustrated in a very diagrammatically simplified manner in the following drawing figures, in which.

DETAILED DESCRIPTION OF THE INVENTION

Figure 1:
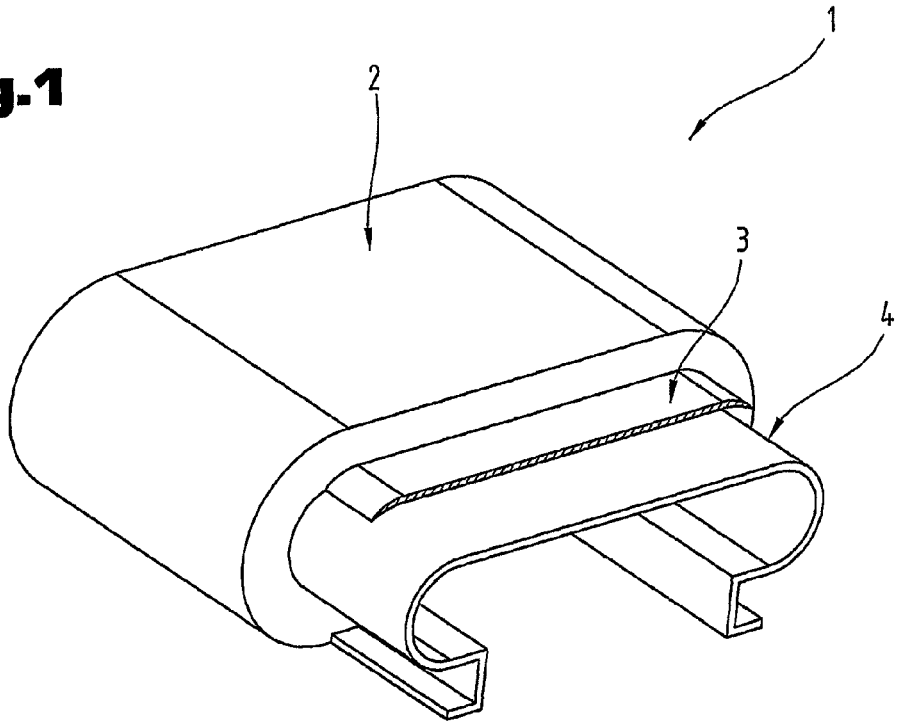
FIG 1 is a section from a handrail in oblique view.

In the differently described embodiments the same parts are provided with the same reference numbers or the same component designations, wherein the disclosures contained in the entire specification can be applied analogously to the same parts with the same reference numbers or the same component designations. The location data selected in the specification, such as, e.g., at the top, at the bottom, at the side, etc., also refer to the drawing figure directly described and shown and should be applied analogously to the new location in the event of a change in location. Furthermore, individual features or combinations of features from the different exemplary embodiments shown and described can also represent per se independent, inventive solutions or solutions according to the invention.

All of the data regarding value ranges in this specification should be understood to include any and all partial ranges therefrom, e.g., in the specification 1 to 10 is to be understood in that all partial ranges, starting from the lower limit 1 and the upper limit 10 are included, i.e., all partial range begin with a lower limit of 1 or greater and end with an upper limit of 10 or below, e.g., 1 to 1.7, or 3.2 to 8.1 or 5.5 to 10.

FIG 1 shows a handrail 1 for an escalator or a moving walkway. This handrail comprises a grip piece 2, which faces the user of the escalator or moving walkway in the installed position of the handrail 1. A tensile carrier 3 can be arranged in the grip piece 2, which tensile carrier absorbs longitudinal forces that act on the handrail 1, and thus prevents at least in part changes in the length of the handrail 1. A sliding layer 4 is arranged on the underside of the handrail 1, via which sliding layer the handrail 1 can be brought into engagement with guide devices, not shown, such as, for example, the balustrade of an escalator, as well as drive devices, which are known from the prior art.

The drive of the handrail 1 can be carried out in any desired manner, as already known from the prior art. Drive devices of this type are, e.g., reel drives, track drives, etc.

The tensile carrier 3, as is known per se, can comprise a metal or of an alloy, e.g., of steel. Furthermore, the tensile carrier 3 can comprise individual wires or steel cables. It is likewise possible that the tensile carrier 3 is a continuous steel band or the like.

The sliding layer 4 usually comprises a fabric of threads and is used to reduce the friction between the handrail 1 and the guide device during the movement of the handrail to an extent that are necessary for the drive of the handrail 1. In principle, the sliding layer 4 can be embodied according to the prior art, so that reference can be made to the relevant literature or according to the invention, as set forth below in more detail. The sliding layer 4 can be adhered to the grip piece 2 or connected to the grip piece 2 in a different manner, e.g., in that a rubber material is attached to the surface of the sliding layer 4 before it is installed and this rubber material is connected to the other layers of the handrail 1 during the production of the handrail, e.g., the vulcanization. It is likewise conceivable that if the handrail 1 is produced by an extrusion method, the sliding layer 4 is fed to the extruder and the grip piece 2 is extruded onto this sliding layer.

Figure 2:
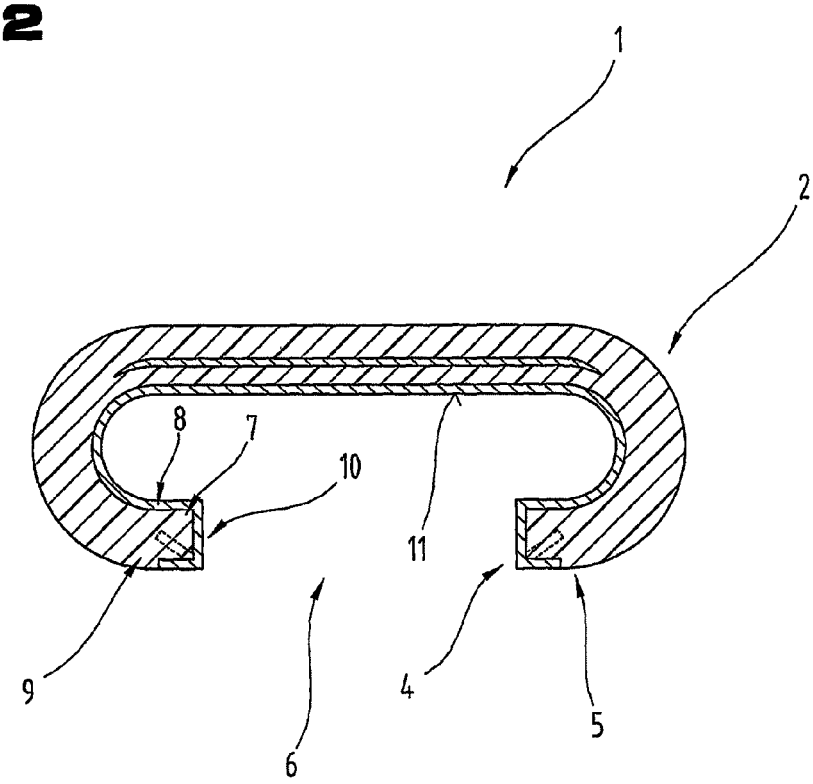
FIG 2 shows the handrail according to FIG 1 in cross section.

The sliding layer 4, as can be seen better from FIG 2, extends into an outer lip area 5 of the grip piece 2 of the handrail 1. However, it is also conceivable that the sliding layer 4 merely via a partial area of a recess 6 that is defined by the cross section of the handrail 1 and in the present exemplary embodiment of the invention, since the handrail has a C-shaped profile, is embodied in a T-shaped manner. For example, this sliding layer 4 can extend up to an inner edge 7 of the recess 6, wherein the edge 7 can be located at a transition between an at least approximately horizontal area 8 of a lip 9 of the handrail 1 and an at least approximately vertical area 10 of an inner surface 11 of the handrail 1.

Furthermore, it is possible that the sliding layer 4 is anchored with its lateral end areas in the grip piece 2, i.e., projects into the grip piece 2 with these end areas, as indicated by broken lines in FIG 2.

According to the embodiment shown in FIGS. 1 and 2, the grip piece 2 is embodied in one piece, i.e., in one layer. It is likewise possible within the scope of the invention to embody this grip piece in multiple layers with a reinforcing layer, as set forth in more detail below.

The grip piece 2 is produced from a thermoplastic elastomer. As known per se, thermoplastic elastomers are polymer materials that combine the properties of elastomers and the processing properties of thermoplastics. This is achieved in that soft and elastic segments with high expandability and low glass-transition temperature as well as hard, crystallizable segments with low expandability, high glass-transition temperature and tendency to form associates (physical crosslinking) are present at the same time in the macromolecules of the corresponding plastics. Usually the soft segments and hard segments are incompatible with one another and are present as individual phases. Thermolabile, reversibly fissile crosslink points, mostly of a physical but also of a chemical nature, are thus characteristic of thermoplastic elastomers. According to the invention, the proportions of the soft segments and hard segments are measured such that they are selected from the ranges given above. Handrails 1 can thus be produced in a relatively cost-effective manner with processing methods for thermoplastics, for example, extrusion or co-extrusion, which on the one hand have a sufficient rigidity, and on the other hand also render possible sufficient bending, in order to thus withstand undamaged over a long period the negative or positive bending normally occurring for handrails 1 in the area of the drives and deflections. Furthermore, through the soft segments a corresponding tactile quality is achieved that is comparable at least to that known from handrails of natural rubber.

Within the scope of the invention, thermoplastic polyurethanes (TPU) or thermoplastic vulcanisates (TPV) are particularly used as thermoplastic elastomers. However, it is also possible to use other thermoplastic elastomers, such as, e.g., styrene-based thermoplastic elastomers (SBS, SIS, SIBS), thermoplastic natural rubber (NR-TP), EVA/PVDC blends, NBR/PP blends, polyether ester, polyether aramides, olefin-based thermoplastic elastomers, thermoplastic nitrile rubber (TP-NBR), thermoplastic fluorinated rubber (TP-FKM), thermoplastic silicone rubber (TP-Q), copolymer polyether ester (CPE, CPA), polyether block aramides (PEBA), blends of crosslinked EPM or EPDM with polyolefins (TPO), blends of uncrosslinked EPM or EPDM in polyolefins (EPDM/PP).

A thermoplastic polyurethane according to the invention can comprise, e.g., short-chain diols with isocyantes for hard segments, long-chain polyester diols and/or polyether diols for the soft segments in the form of an $[AB]_n$-block polymers. The short-chain diols can thereby have molecular masses $M_g$ in the range of 61 to approx. 600 (weight average), the long-chain diols can have molecular masses $M_n$ in the range between 600 and 4,000 (number average). However, polyols, in particular of the above-mentioned type with molecular masses between $M_g$ 1,000 and 2,000 (weight average) and/or an acid number <1 mg KOH/g polyol can also be used as hydroxyl compounds. For example, mixtures of long-chain polyols, diisocyanates and short-chain diols can thus be produced within the scope of the invention. In addition, this mixture can also contain further additives, for example, internal separating agents, montanic acid ester, silicones, aramide waxes, softening agents, in the event that the thermoplastic elastomer is to have a hardness of <70 ShA. Aromatic processing oils, naphthenic processing oils or paraffinic processing oils can be used as softening agents. Softening agents of this type are known to one skilled in the art working in this field, and reference is made here by way of example to the Association of the German Rubber Industry Guideline (W.d.K.-Leitlinie) (wdk) 1315, page 2, with respect to the specification.

The production of the thermoplastic polyurethanes can be carried out within the scope of the invention in a solvent-free manner, with an NCO/OH ratio that is stoichiometric in a particular embodiment, but no less than in approx. 0.95 or 0.97.

Other production methods are of course likewise within the scope of the invention, for example using solvents, etc.

In Table 1 below some exemplary formulas are given for thermoplastic polyurethanes that are used within the scope of the invention. The NCO/OH ratio of these seven mixtures lies in the range of between 1.01 and 1.05.

TABLE 1

| | Parts by weight | | | | | | |
|---|---|---|---|---|---|---|---|
| Formula examples | No. 1 | No. 2 | No. 3 | No. 4 | No. 5 | No. 6 | No. 7 |
| Poly(oxytetramethylene)glycol 2000 | 100.0 | 100.0 | | | | 100.0 | |
| Poly(1,6-hexanediol carbonate)glycol 3000 | | | 100.0 | 100.0 | | | |
| Polycaprolacton glycol 2000 | | | | | 100.0 | | 100.0 |
| 1,4-butanediol | | | | 6.5 | | | |
| 2-ethyl-1,3-hexanediol | 15.1 | | 17.0 | | 16.5 | 15.1 | |
| 2,2,4-trimethylpentane-1,3-diol | | 15.1 | | | | | 15.1 |
| Tinuvin B75 | 1.6 | 1.6 | 1.6 | 1.6 | 1.6 | 1.6 | 1.6 |
| 4,4'-diphenylmethanediisocyanate (MDI) | 39.1 | 39.1 | 38.2 | 26.9 | 37.4 | | |
| 4,4'-dicyclohexylmethanediisocyanate ($H_{12}$-MDI) | | | | | | 40.9 | 40.9 |

With respect to the thermoplastic vulcanisates, such as EPDM/PP blends, are used and a composition are given to this end in Table 2 by way of example. A peroxidic resin crosslinking system can thereby be used as the crosslinking system.

TABLE 2

| | Material 1 60 A | Material 2 62 A | Material 3 70 A | Material 4 60 A |
|---|---|---|---|---|
| Softening agent (paraffinic) | 39% | 44% | 31% | 36% |
| EPDM | 34% | 32% | 36% | 30% |
| PP | 13% | 14% | 16% | 20% |
| Carbon black | — | 3% | — | — |
| Light filler (kaolin) | 11% | 5% | 15% | 11% |
| Crosslinking system | 3% | 2% | 2% | 3% |

The numerical data in the first line below the respective material hereby mean the hardnesses according to Shore A.

Exemplary formulas for further thermoplastic elastomers that can be used within the scope of the invention are given in Tables 4 through 8, wherein "phr" stands for "parts per hundred rubber."

TABLE 3

| SBR/BR/NR | phr | % |
|---|---|---|
| SBR | 40.0 | 18.3 |
| BR | 50.0 | 22.8 |
| NR | 10.0 | 4.6 |
| Carbon black | 75.0 | 34.2 |
| Oil | 17.0 | 7.8 |
| TOR | 10.0 | 4.6 |
| Antiozonant wax | 2.0 | 0.9 |
| ZnO | 5.0 | 2.3 |
| Stearic acid | 1.0 | 0.5 |
| Sulfur | 2.0 | 0.9 |
| TBBS | 2.0 | 0.9 |
| HMT | 2.0 | 0.9 |
| HPPD | 2.0 | 0.9 |
| TMQ | 1.0 | 0.5 |
| | 219.0 | |

TABLE 4

| EPDM | PHR | % |
|---|---|---|
| EPDM | 100.0 | 37.2 |
| Carbon black | 100.0 | 37.2 |
| Oil | 60.0 | 22.3 |
| ZnO | 5.0 | 1.9 |
| Stearic acid | 1.0 | 0.4 |
| Sulfur | 1.0 | 0.4 |
| TMTD | 1.2 | 0.4 |
| MBT | 0.8 | 0.3 |
| | 269.0 | |

TABLE 5

| CSM | PHR | % |
|---|---|---|
| CSM | 100.0 | 45.7 |
| Kaolin | 80.0 | 36.5 |
| MgO | 4.0 | 1.8 |
| Oil | 30.0 | 13.7 |
| Pentaerythritol | 3.0 | 1.4 |
| DPTT | 2.0 | 0.9 |
| | 219.0 | |

TABLE 6

| NR/BR | PHR | % |
|---|---|---|
| NR | 70.0 | 35.0 |
| BR | 30.0 | 15.0 |
| Carbon black | 50.0 | 25.0 |
| Silica | 20.0 | 10.0 |
| Silane | 1.0 | 0.5 |
| Oil | 15.0 | 7.5 |
| 6PPD | 3.0 | 1.5 |
| Antiozonant wax | 2.0 | 1.0 |
| ZnO | 5.0 | 2.5 |
| Stearic acid | 1.0 | 0.5 |
| Sulfur | 1.4 | 0.7 |
| TBBS | 1.8 | 0.9 |
| | 200.2 | |

TABLE 7

| NBR | PHR | % |
|---|---|---|
| NBR | 100.0 | 46.6 |
| Carbon black | 70.0 | 32.6 |
| Chalk | 20.0 | 9.3 |
| DOP | 8.0 | 3.7 |
| 6PPD | 3.0 | 1.4 |
| Antiozonant wax | 2.0 | 0.9 |
| ZnO | 5.0 | 2.3 |
| Stearic acid | 1.0 | 0.5 |
| Sulfur | 0.4 | 0.2 |
| TMTD | 1.5 | 0.7 |
| OTOS | 2.5 | 1.2 |
| CBS | 1.0 | 0.5 |
| | 214.4 | |

These mixtures or the handrails 1 produced therefrom all show—more or less pronounced—positive properties, such as, e.g., a higher creep resistance, better elasticity, etc.

The invention is not restricted to the examples of the formulas given or the individual compounds given as preferred for producing these formulas, instead they are to be seen within the scope of the invention given in the claims for protection.

Further additives, such as, e.g., colorants, etc., can be added to all of the mixtures. Since the handrail 1 according to the invention comprises a thermoplastic elastomer, the splice formation, i.e., the connection of the two ends of the handrail 1 to form an endless belt, is simplified compared to the conventional splice forming methods in the field of natural rubber. For example, simple processing techniques from thermoplastic chemistry, for example, extrusion methods, can be used for this purpose. Likewise, a direct welding or adhesion of the two ends to one another is possible. The positioning of a connecting piece and its complex pattern embodiment for overlapping individual layers in order to produce a permanent connection may thus possibly be omitted.

In addition to the embodiment in one layer of the grip piece 2, within the scope of the invention it is also possible to embody it, as already mentioned, in multiple layers, i.e., in at least two layers. According to the invention it can thereby be provided for a further layer to be arranged as a reinforcing layer beneath a first layer that faces the user of the escalator or moving walkway. Short fibers, as stated above, can be arranged in this reinforcing layer, wherein the orientation of these short fibers in the reinforcing layer is completely arbitrary, i.e., no preferred direction is prescribed. This means that at least one proportion of the short fibers will come to rest crosswise to the longitudinal extension or at an angle to the longitudinal extension of the handrail 1, and thus the handrail 1 can be given a corresponding transverse rigidity, in particular also a lip rigidity. For this reason a majority of the short fibers is also arranged at an angle to the longitudinal extension of the handrail 1. This second layer can thereby have the same hardness as the cover layer of the grip piece 2. Other hardnesses are likewise conceivable, although layers of equal hardness are used in a particular embodiment. The layers of the grip piece 2 can be formed by different materials, in particular different thermoplastic elastomers, but the embodiment from the same elastomer is likewise also possible. A coextrusion method can be used to produce a multilayer handrail, wherein the short fibers have already been added to the plastic strand.

Furthermore, it is also possible that the cover layer, i.e., the outermost layer of the grip piece 2, is drawn into the lip area, so that therefore the other layers or the inner layer is covered by the cover layer, therefore nothing can be seen from the outside of the inner layers thus produced, since these inner layers are covered on the underside by the sliding layer 4.

In an embodiment variant in the case of the multilayer structure of the handrail 1, i.e., of the grip piece 2, in turn a tensile carrier 3 can be provided, wherein this tensile carrier, in a particular embodiment, is embedded in the cover layer, that is, for example, the reinforcing layer is embodied free from a tensile carrier.

The use of thermoplastic elastomers for the handrails 1 means the advantage can also be achieved that they can be given a coloration with relatively simple means compared to natural rubber, i.e., a color that does not correspond to that of the base material. This can be achieved, for example, in that the base material itself is colored, i.e., is provided with a colorant, however, on the other hand it is also possible with coating systems already known to paint a layer onto the handrail, i.e., the grip piece 2, in particular during the extrusion process, that is to carry out a so-called online coating.

Figure 3:
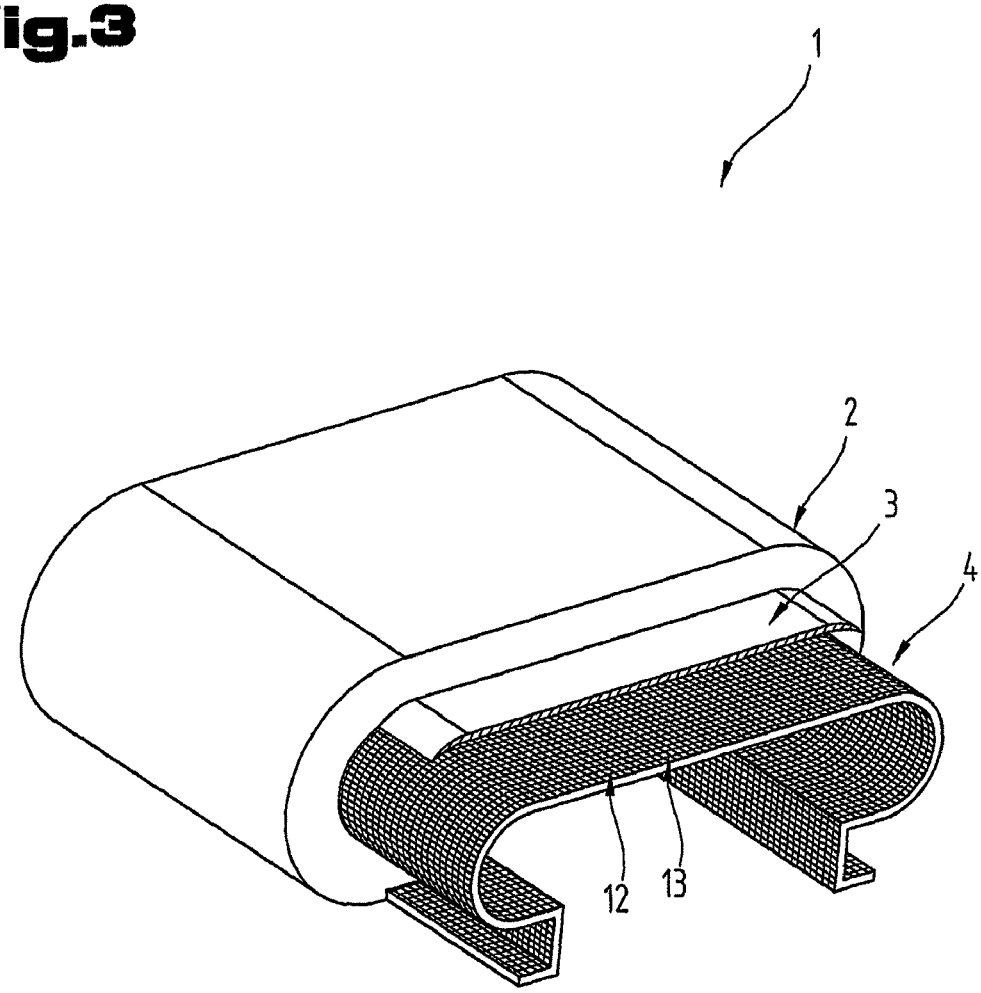
FIG 3 shows another embodiment of a handrail in oblique view.

FIG 3 shows another embodiment of a handrail 1 according to the invention. This comprises in turn the grip piece 2, the tensile carrier 3 in the grip piece 2, and the sliding layer 4 on the underside of the grip piece 2. The grip piece 2 in turn can be embodied in one layer or multiple layers, wherein the layers can also have different mechanical properties and can comprise different materials. In general the grip piece 2 is made of a polymer material, that is in particular of a thermoplastic elastomer, such as, e.g., TPU, TPV, TPO, of EPDM, natural rubber, CSM, CR, SBR, BR, NBR, BU, and mixtures or blends thereof.

The sliding layer 4 comprises a structure of warp threads 12 running at least approximately in the longitudinal direction of the handrail 1 and weft threads 13 running at least approximately orthogonally thereto. According to the invention, the weft threads have a higher rigidity than the weft threads, i.e., they are more rigid, that is they have a higher modulus of elasticity. The warp threads or weft threads can be produced from above-mentioned materials, wherein the fabric of the sliding layer 4, i.e., the warp threads 12 and the weft threads 13, can comprise the same material with different rigidities or materials differing from one another. For example, combinations of staple fibers of polyamide or polyester can be used for the warp threads 12 with fibers of polyester, multifilament yarns or aramide fibers for the weft threads 13. This means that the handrail 1 can be given a higher lip rigidity while at the same time achieving flexibility in the longitudinal direction. The incorporation or arrangement of the sliding layer 4 into or on the grip piece 2 can be carried out here, as described for FIGS. 1 and 2.

The weft threads 13 can thereby have an initial modulus of elasticity according to ASTM D 885 selected from a range with a lower limit of 6.0 GPa and an upper limit of 175 GPa. It is likewise possible for the weft threads 13 to have an initial modulus of elasticity selected from a range with a lower limit of 7.0 GPa and an upper limit of 165 GPa or of from a range with a lower limit of 8.0 GPa and an upper limit of 150 GPa. For example, the weft threads can have an initial modulus of elasticity according to ASTM D 885 of 80 GPa, 85 GPa, 90 GPa, 100 GPa, 115 GPa, 125 GPa or 150 GPa.

In return, the warp threads 12 can have an initial modulus of elasticity according to ASTM D 885 selected from a range with a lower limit of 4.5 GPa and an upper limit of 12 GPa.

In a particular embodiment, para-aramide fibers are used as weft threads 13, for example, Twaron® or Kevlar® fibers.

The exemplary embodiments represent possible variations of the handrail 1 according to the invention, although the invention is not restricted to the these specific embodiments, but instead diverse combinations of the individual embodiments among one another are also possible and this variation possibility based on the directive for technical actions through the present invention lies within the ability of one skilled in the art working in this technical field. Therefore, all conceivable embodiments that are possible through combinations of individual details of the embodiments shown and described are also covered by the scope of protection.

To make it easier to understand the structure of the handrail 1, the handrail 1 or its components have been shown in part not to scale and/or enlarged and/or reduced in size.

The object on which the independent inventive solutions are based can be taken from the specification.

Above all, the individual embodiments shown in FIGS. 1, 2; 3 form the subject matter of independent inventive solutions. The objectives and solutions according to the invention in this regard can be taken from the detailed descriptions of these figures.

LIST OF REFERENCE NUMBERS

1 Handrail
2 Grip piece
3 Tensile carrier
4 Sliding layer
5 Lip area
6 Recess
7 Edge
8 Area
9 Lip
10 Area
11 Surface
12 Warp threads
13 Weft threads

The invention claimed is:

1. A handrail for escalators or moving walkways, said handrail comprising:

a grip piece comprising a thermoplastic elastomer having macromolecules;

said thermoplastic elastomer comprising soft segments and hard segments in the macromolecules;

a ratio of proportions of the soft segments to the hard segments comprising a ratio selected from a range having a lower limit of equal to or greater than 1:1 and an upper limit of equal to or less than 9:1.

2. A handrail according to claim 1, wherein:

said range has a lower limit of equal to or greater than 1.5:1 and an upper limit of equal to or less than 6:1.

3. A handrail according to claim 1, wherein:

said range has a lower limit of equal to or greater than 2.5:1 and an upper limit of equal to or less than 4:1.

4. A handrail according to claim 1, wherein:

the handrail comprises an outer side adapted to be contacted by a user during use of the handrail and an underside adapted to be engaged with guide devices;

the handrail further comprises a sliding layer arranged on the underside of the grip piece.

5. A handrail according to claim 1, wherein:

the proportion of hard segments is selected from a range with a lower limit of 10% and an upper limit of 50%, and/or the proportion of the soft segments is selected from a range with an upper limit of 90% and a lower limit of 50%, based on the composition of the thermoplastic elastomer.

6. A handrail according to claim 1, wherein:

the proportion of hard segments is selected from a range with a lower limit of 15% and an upper limit of 40%, and/or the proportion of the soft segments is selected from a range with an upper limit of 85% and a lower limit of 60%, based on the composition of the thermoplastic elastomer.

7. A handrail according to claim 1, wherein:

the proportion of hard segments is selected from a range with a lower limit of 20% and an upper limit of 30%, and/or the proportion of the soft segments is selected from a range with an upper limit of 80% and a lower limit of 70%, based on the composition of the thermoplastic elastomer.

8. A handrail according to claim 1, wherein:

a degree of crystallinity of the thermoplastic elastomer is selected from a range with a lower limit of 10% and an upper limit of 50%.

9. A handrail according to claim 1, wherein:

a degree of crystallinity of the thermoplastic elastomer is selected from a range with a lower limit of 20% and an upper limit of 40%.

10. A handrail according to claim 1, wherein:

a degree of crystallinity of the thermoplastic elastomer is selected from a range with a lower limit of 25% and an upper limit of 30%.

11. A handrail according to claim 1, wherein:

the thermoplastic elastomer is formed by reaction of compound(s) comprising at least two hydroxy groups with at least one isocyanate from a group comprising aromatic isocyanates, in particular diisocyanates, such as, e.g., 4,4'-methylene diphenyl diisocyanate, 3,3'-dimethyl-4, 4'-biphenyldiisocyant, 1,5-naphthalene-diisocyanate, toluylene diisocyanate, aliphatic isocyanate, such as, e.g., 4,4'-dicyclohexylmethane diisocyanate, hexamethylene diisocyanate, hexamethylene diisocyanate-triisocyanurate, isophorone diisocyanate.

12. A handrail according to claim 1, wherein:

the thermoplastic elastomer is a thermoplastic vulcanisate (TPE-V).

13. A handrail according to claim 1, wherein:

grip piece is embodied in one layer.

14. A handrail according to 1, wherein:

at least one tensile carrier is embedded in the grip piece.

15. A handrail according to claim 1, wherein:

the grip piece is embodied in a multilayered manner and at least several of the layers are formed by thermoplastic elastomers.

16. A handrail according to claim 1, wherein:

the grip piece is embodied in a multilayered manner and at least several of the layers are formed by different thermoplastic elastomers.

17. A handrail according to claim 16, wherein:

at least one tensile carrier is embedded in an outer layer of the grip piece.

18. A handrail according to claim 1, wherein:

the handrail comprises an outer side adapted to be contacted by a user during use of the handrail and an underside adapted to be engaged with guide devices;

the grip piece is embodied in at least two layers, said two layers comprising a cover layer and a reinforcing layer arranged on the underside;

short fibers are embedded in the reinforcing layer.

19. A handrail according to claim 18, wherein:

the short fibers are in the form of at least one material selected from a group of materials comprising inorganic materials, such as, e.g., carbon, glass, metals or alloys, such as, e.g., steel, aluminum, copper and organic materials, such as, e.g., synthetic fibers, for example of nylon, polyester, aromatic polyamides (Kevlar), or natural fibers, such as of cotton, cellulose fibers, viscose or mixtures thereof.

20. A handrail according to claim 18, wherein:

the reinforcing layer is embodied interrupted in the longitudinal direction.

21. A handrail according to claims 18, wherein:

the reinforcing layer and the cover layer have at least approximately an identical hardness.

22. A method of making the handrail of claim 1.

23. A method according to claim 22, comprising:

extruding the handrail.

24. A method according to claim 22, wherein the handrail has multiple layers, comprising:

coextruding the handrail.

25. A method according to claim 22, comprising:

making the handrail by stacking individual layers;

press vulcanizing the individual layers.

26. A handrail for escalators or moving walkways, said handrail comprising:

a grip piece comprising a thermoplastic elastomer;

said thermoplastic elastomer comprising soft segments and hard segments;

a ratio of proportions of the soft segments to the hard segments comprising a ratio selected from a range having a lower limit of equal to or greater than 1:1 and an upper limit of equal to or less than 9:1;

the thermoplastic elastomer being a thermoplastic polyurethane block copolymer at least comprising monomer units A and B, e.g., a diblock copolymer ($[AB]_n$), a triblock copolymer ($A_n$-$B_m$-$A_n$), a segment copolymer ($[A_a$-$B_b]_n$), a star block copolymer ($[A_n$-$B_m]_X$X where x>2).

27. A handrail according to claim 26, wherein:

a proportion of the monomer units B of molecules of the soft segments in the polymer chain of the thermoplastic polyurethane is selected from a range with a lower limit of 20% and an upper limit of 70%, based on a total mixture of the soft and hard segments.

28. A handrail according to claim 26, wherein:

a proportion of the monomer units B of molecules of the soft segments in the polymer chain of the thermoplastic polyurethane is selected from a range with a lower limit of 30% and an upper limit of 60%, based on a total mixture of the soft and hard segments.

29. A handrail according to claim 26, wherein:

a proportion of the monomer units B of molecules of the soft segments in the polymer chain of the thermoplastic polyurethane is selected from a range with a lower limit of 35% and an upper limit of 50%, based on a total mixture of the soft and hard segments.

30. A handrail according to claim 26, wherein:

the soft segments are formed by at least one long-chain compound with at least two hydroxy groups, in particular a long-chain diol, with a relative molecular mass of 600 to 4000.

31. A handrail according to claim 30, wherein:

the long-chain diol is selected from a group comprising 1,4-bis(2-hydroxyethoxy)benzene[hydroquinone bis-(2-hydroxyethypether], poly tetrahydrofurane, poly(oxytetramethylene)glycol, poly(1,2-oxypropylene)glycol, poly(tetramethylene adipic acid)glycol, poly(ethylene adipic acid)glycol, poly(ϵ-caprolactam)glycol, poly (hexamethylene carbonate)glycol, polycaprolactone.

32. A handrail according to claim 26, wherein:

the soft segments are formed by at least one long-chain compound with at least two hydroxy groups, in particular a polyester diol and/or a polyether diol, with a relative molecular mass of 600 to 4000.

33. A handrail according to claim 26, wherein:

the hard segments are formed by at least one short-chain compound with at least two hydroxy groups, in particular a short-chain diol with a relative molecular mass of 61 to 600.

34. A handrail according to claim 33, wherein:

the short-chain diol is selected from a group comprising 1,4-butanediol,1,6-hexanediol, ethylene glycol, diethylene glycol, triethylene glycol, propylene glycol, dipropylene glycol, 2,2-dimethyl-1,3-propanediol, 1,10-decanediol, 1,4-cyclohexanedimethanol.

35. A handrail according to claim 26, wherein:

the compound(s) comprising at least two hydroxy groups is a polyol, selected from a group comprising polyols based on polyadipates of short-chain diols with two functional hydroxy groups and 2 to 20 carbon atoms, e.g., polycaprolactones, polycarbonate diols and/or polyols with more than two free hydroxy groups, such as, e.g., pentaerythrite.

36. A handrail according to claim 26, wherein:

the compound(s) comprising at least two hydroxy groups is a polyol with a relative molecular mass, selected from a range with a lower limit of 1000 and an upper limit of 2000.

37. A handrail according to claim 26, wherein:

the compound comprising at least two hydroxy groups has an acid number of less than 1 mg KOH/g compound.

38. A handrail for escalators or moving walkways, said handrail comprising:

a grip piece comprising a thermoplastic elastomer;

said thermoplastic elastomer comprising soft segments and hard segments;

a ratio of proportions of the soft segments to the hard segments comprising a ratio selected from a range having a lower limit of equal to or greater than 1:1 and an upper limit of equal to or less than 9:1;

the thermoplastic elastomer being a thermoplastic vulcanisate (TPE-V) formed by an ethylene/propylene diene methylene propylene mixture.

39. A handrail according to claim 38, wherein:

the EPDM proportion of the mixture is selected from a range with a lower limit of 20% and an upper limit of 45%.

40. A handrail according to claim 38, wherein:

the EPDM proportion of the mixture is selected from a range with a lower limit of 25% and an upper limit of 40%.

41. A handrail according to claim 38, wherein:

the EPDM proportion of the mixture is selected from a range with a lower limit of 30% and an upper limit of 35%.

42. A handrail according to claim 38, wherein:

the polypropylene proportion of the mixture is selected from a range with a lower limit of 5% and an upper limit of 25%.

43. A handrail according to claim 38, wherein:

the polypropylene proportion of the mixture is selected from a range with a lower limit of 7% and an upper limit of 17%.

44. A handrail according to claim 38, wherein:

the polypropylene proportion of the mixture is selected from a range with a lower limit of 10% and an upper limit of 15%.

45. A handrail according to claim 38, wherein:

the EPDM/PP mixture contains at least one further additive selected from a group comprising softening agents, fillers, colorants, antibacterial active ingredients, cross-linking agents.

* * * * *